US009256178B2

(12) United States Patent
Shimizu

(10) Patent No.: US 9,256,178 B2
(45) Date of Patent: Feb. 9, 2016

(54) POWER SUPPLY CONTROL APPARATUS, IMAGE PROCESSING APPARATUS, POWER SUPPLY CONTROL METHOD, AND RECORDING MEDIUM STORING A POWER SUPPLY CONTROL PROGRAM

(71) Applicant: Takafumi Shimizu, Kanagawa (JP)

(72) Inventor: Takafumi Shimizu, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/599,599

(22) Filed: Jan. 19, 2015

(65) Prior Publication Data

US 2015/0205247 A1 Jul. 23, 2015

(30) Foreign Application Priority Data

Jan. 20, 2014 (JP) ..... 2014-007578

(51) Int. Cl.
*G03G 15/00* (2006.01)

(52) U.S. Cl.
CPC ..... *G03G 15/5004* (2013.01); *G03G 15/80* (2013.01); *G03G 15/5083* (2013.01); *G03G 2215/00983* (2013.01)

(58) Field of Classification Search
CPC ..... G03G 15/50; G03G 15/5004; G03G 15/5083; G03G 15/80; G03G 2215/00983
USPC ..... 399/85, 88
See application file for complete search history.

(56) References Cited

U.S. PATENT DOCUMENTS

2010/0028030 A1* 2/2010 Maekawa ..... 399/43

FOREIGN PATENT DOCUMENTS

JP 10-150511 6/1998
JP 2006-027007 2/2006

* cited by examiner

*Primary Examiner* — Benjamin Schmitt
(74) *Attorney, Agent, or Firm* — Harness, Dickey & Pierce, P.L.C.

(57) ABSTRACT

A novel power supply control device includes an external power supply unit that generates external driving power from external power source, a storing power supplying unit that generates stored driving power from stored power source, a selection unit that selects either the external driving power or the stored driving power, a power mode switching unit that switches between a normal mode and an energy saving mode that consumes less power consumption than the normal mode, a determination unit that determines whether or not current time is within a peak power shift time zone in which usage of the external power is suppressed, and a controlling unit that instructs the selection unit to select the stored power as the driving power and instructs the power mode switching unit to switch power mode to the energy saving mode immediately after finishing an operation during the power peak shift time zone.

11 Claims, 6 Drawing Sheets

| | START | END |
|---|---|---|
| POWER PEAK SHIFTING TIME ZONE | 10:30 | 15:00 |
| ENERGY SAVING PRIORING TIME ZONE | 12:00 | 13:00 |

| | SETTINGS |
|---|---|
| NORMAL WAITING TIME | 5 MIN |
| STORED REMAINING THRESHOLD | 20% |
| STORED POWER DRIVING TIME THRESHOLD | 15 MIN |

POWER SUPPLY CONTROL APPARATUS, IMAGE PROCESSING APPARATUS, POWER SUPPLY CONTROL METHOD, AND RECORDING MEDIUM STORING A POWER SUPPLY CONTROL PROGRAM

CROSS-REFERENCE TO RELATED APPLICATION

This patent application is based on and claims priority pursuant to 35 U.S.C. §119 to Japanese Patent Application No. 2014-007578, filed on Jan. 20, 2014 in the Japan Patent Office, the entire disclosure of which is hereby incorporated by reference herein.

BACKGROUND

1. Technical Field

The present invention relates to a power supply control apparatus, an image processing apparatus, a power supply control method, and a recording medium storing a power supply control program.

2. Background Art

Recently, power peak shift that shifts the peak time at which electric power is consumed has been introduced. This reduces amount of electricity used during a time zone when electric power demand increases rapidly.

Generally, in shifting the peak of power, during time zone when the electric power demand is high, time at which commercial external electric power is demand is distributed by switching a power supply source for driving an image processing apparatus from an external driving power supply generated from the commercial external electric power to a charged driving power supply generated from charged electric power output by a charged storage battery.

For example, facsimile machines that are connected to an Uninterrupted Power Supply (UPS) and have multiple standby modes that are switched according to electric power consumption levels are proposed. If the commercial power supply that the UPS is connected terminates and a battery included in the UPS supplies power, the facsimile machine is switched to a standby mode.

SUMMARY

An example embodiment of the present invention provides a power supply control device that includes an external power supply unit that generates external driving power to be supplied to an image processing apparatus from external power source, a storing power supplying unit that generates stored driving power to be supplied to the image processing apparatus from stored power source, a selection unit that selects either the external driving power or the stored driving power as driving power supplied to the image processing apparatus, a power mode switching unit that switches power mode of the image processing apparatus between a normal mode and an energy saving mode that consumes less power consumption than power consumption for the normal mode, a determination unit that determines whether or not current time is within a peak power shift time zone in which usage of the external power is suppressed and further determines whether the image processing apparatus is performing an operation, and a controlling unit that instructs the selection unit to select the stored power as the driving power when the determination unit determines that the current time is within the peak power shift time zone and further instructs the power mode switching unit to switch power mode of the image processing apparatus to the energy saving mode immediately after the image processing apparatus ends the operation being performed during the power peak shift time zone.

BRIEF DESCRIPTION OF THE DRAWINGS

A more complete appreciation of the disclosure and many of the attendant advantages thereof will be readily obtained as the same becomes better understood by reference to the following detailed description when considered in conjunction with the accompanying drawings.

DETAILED DESCRIPTION

Figure 1:
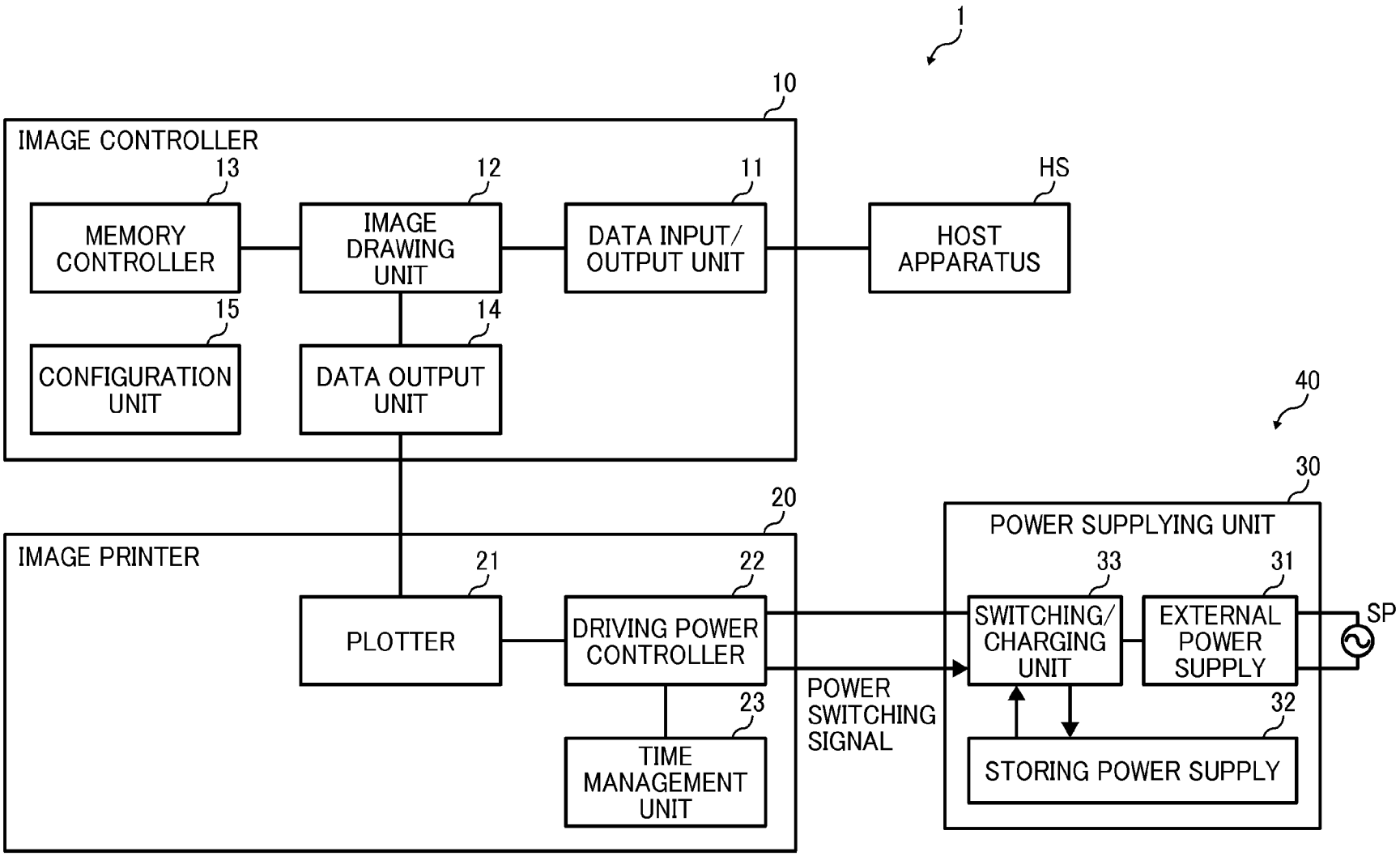
FIG. 1 is a block diagram illustrating an image forming apparatus as an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In the conventional technology, if the charged driving power supply in the UPS supplies the driving power, the machine is just switched to a standby mode among multiple standby modes. That is, normally, in standby modes, the machine transitions to an energy saving mode with less electric power consumption after preset waiting time elapses. Therefore, if the conventional technology is applied with power peak shift, the machine transitions to the energy saving mode when waiting time elapses after transitioning to the standby mode, and the charged driving power supply is consumed during the waiting time since the normal power mode that the machine can operate normally continues during the waiting time. As a result, average charge remaining of the storage battery becomes low during the time zone of power peak shift, and if the commercial external power supply disappears due to an outage etc. during the power peak shift, drivable time using the charged driving power supply becomes short afterwards. This may reduce operability of the image processing apparatus.

In the embodiment described below, consumed amount of the charged driving power supply during the power peak shift time zone can be reduced effectively.

First Embodiment

Referring now to FIGS. 1 to 7, a power supply control apparatus, an image processing apparatus, a power supply control method, and a recording medium storing a power supply control program are described according to embodiments of the present invention. FIG. 1 is a block diagram illustrating a part of an image forming apparatus 1 that relates to power peak shift in this embodiment.

In FIG. 1, the image forming apparatus (image processing apparatus) 1 includes an image controller 10, an image printer 20, and a power supply unit 30, etc. The image forming apparatus 1 is connected to a host apparatus HS such as a computer via a communication channel such as a wired/wireless Local Area Network (LAN) etc.

For example, the host apparatus HS is a general-purpose hardware/software-implemented computer etc., and the host apparatus HS transfers print data to be printed as a print job along with configured print setting information to the image forming apparatus 1 via the communication channel.

In this embodiment, the image forming apparatus 1 performs image processing such as an image printing process that prints an image on paper based on the image data transferred from the host apparatus HS, a memory storing process that stores the image data transferred from the host apparatus HS after performing a desired process, and a data transferring process that transfers the image data in the memory to a specified destination.

The image controller 10 includes a data input/output unit 11, an image drawing unit 12, a memory controller 13, a data output unit 14, and a configuration unit 15 etc. The image controller 10 transfers/receives the image data to/from the host apparatus HS and performs image processing to output or store images.

The image printer 20 includes a plotter 21, a driving power controller 22, and a time management unit 23 etc. The image printer 20 prints an image on paper using the plotter 21 while controlling power supply.

The power supply unit 30 includes an external power supply 31, a charged (storing) power supply 32, and a switching/charging unit 33 etc. The power supply unit 30 supplies driving power to each unit in the image forming apparatus 1 especially the driving power controller 22, while controlling switching between the external driving power supply and the charged driving power supply.

The driving power controller 22, the time management unit 23, the external power supply 31, the storing power supply 32, and the switching/charging unit 33 function as a power supply controller (a power supply controlling unit) 40 that performs a power supply control method that reduces consumption of charged driving power during power peak shift time zone (described later) effectively as a whole.

The image drawing unit 12 is implemented by a Central Processing Unit (CPU), a Read Only Memory (ROM), a Random Access Memory (RAM), and an Application Specific Integrated Circuit (ASIC) etc. The image drawing unit 12 stores various programs such as an operating system of the image forming apparatus 1 and necessary system data in the ROM. The image drawing unit 12 controls the entire image forming apparatus 1 using the RAM as a work memory based on the program stored in the ROM by the CPU and performs processes as the image forming apparatus 1. The ASIC in the image drawing unit 12 transfers/receives data to/from peripheral modules and performs various processes on the image data under the control of the CPU.

The data input/output unit 11 is implemented by a network interface circuit (NIC) etc. for example. The data input/output unit 11 is connected to the host apparatus HS via the communication channel described above, communicates with the host apparatus under the control of the image drawing unit 12, and transfers/receives data such as image data and control signals to/from the host apparatus HS.

The memory controller 13 includes a mass storage memory such as a hard disk drive, and a nonvolatile RAM (NVRAM) etc., and the memory controller 13 reads/writes data such as the image data from/in the mass storage memory. For example, the image drawing unit 12 analyzes the image data that the data input/output unit 11 receives from the host apparatus HS and expands drawing data drawn in the mass storage memory in the memory controller 13. In addition, after reading the image data expanded in the mass storage memory the image drawing unit 12 reads the image data expanded in the mass storage memory in the memory controller 13, outputs the image data to the plotter 21 in the image printer 20 via the data output unit 14, and transfers the image data to a specified destination such as the host apparatus HS for example via the data input/output unit 11.

The data output unit 14 is implemented by a communication interface, etc. for example. The data output unit 14 transfers/receives the image data and signals to/from the plotter 21 in the image printer 20 under the control of the image drawing unit 12.

The configuration unit 15 is implemented by a control panel, which includes various operating keys and a display such as a liquid crystal display. The operating keys are used for operating the image forming apparatus 1 by user operation. The display displays input data of the operating keys and various information that the image forming apparatus 1 reports to the user. In alternative to the operating keys, the control panel (configuration unit 15) may receive a user input through a touch panel provided for the display.

The plotter 21 forms an image on paper as a recording medium by a predetermined image forming method using driving power supplied by the driving power controller 22. For example, the plotter 21 forms the image on the paper by image forming methods such as an electrophotography method and an inkjet method based on the image data and the control signals transferred by the image controller 10.

The driving power controller (a power mode switching unit, a status determination unit, a determination unit, and a controlling unit) 22 controls supplying/cutting off driving power supplied by the power supply unit 30 to each unit in the plotter 21 and the image controller 10 and controls amount of supplied electric power.

That is, the driving power controller 22 is implemented by the CPU, the ROM, the RAM, and the internal memory etc. for example. The driving power controller 22 stores various programs such as a power supply control program in this embodiment and necessary system data in the ROM. In addition, the driving power controller 22 includes a nonvolatile memory such as the NV RAM as an internal memory, and the driving power controller 22 stores initial values and setting values configured afterwards for various time used for performing the power supply control method in this embodiment in the internal memory. Initial values such as power peak shift time zone, normal waiting time, threshold of charge remaining, threshold of driving time using the storage battery, and energy saving prioritizing time zone etc. are stored in the internal memory of the driving power controller 22 preliminarily. If the parameters such as the time zone of shifting peak of power, the normal waiting time, the threshold of charge remaining, the threshold of driving time using the storage battery, and the energy saving prioritizing time zone described above are configured using operating keys on the configuration unit 15 or using the host apparatus HS, the driving power controller 22 accepts the configuration and modifies data in the internal memory based on the configured content storing the initial values. As described above, in the time zone of shifting peak of power, time when the commercial external power supply SP is consumed is distributed by switching the power supply of the driving power for the image forming apparatus 1 from the external driving power generated by the commercial external power supply SP to the stored driving power generated by the stored electric power in the charged storing power supply 32 during the time zone when the demand for electric power is high. The normal waiting time is waiting time until the image forming apparatus 1 transitions from the normal mode to the energy saving mode with less power consumption if the image forming apparatus 1 keeps idling in the normal mode (normal power mode). The threshold of charge remaining indicates threshold of charge remaining in the charged power supply 32 that the normal mode is switched to the energy saving mode immediately if the storing power supply 32 supplies the driving power. The threshold of driving time using the storage battery indicates threshold time that the normal mode is switched to the energy saving mode immediately in the time zone of shifting peak of power, and the threshold of driving time using the storage battery indicates threshold time in accumulating predicted working time using the storage battery in the time zone of shifting peak of power when the charged storage battery supplies driving power. In the time zone of prioritizing energy saving, the normal mode is switched to the energy saving mode immediately.

In the driving power controller 22, the CPU utilizes the RAM as the work memory based on the program in the ROM, controls supplying driving power to each unit in the image forming apparatus 1 by the power supply unit 30, and reduces consumption of the charged driving power effectively in the time zone of shifting peak of power as described in this embodiment.

That is, the image forming apparatus 1 operates as the image forming apparatus, which is one example of an image processing apparatus, provided with the power supply controlling unit 40 and that controls supplying power to reduce consumption of charged driving power in the peak power shift time zone according to a power supply control program. The power supply control program is stored in a computer-readable recording medium such as the ROM, an Electrically Erasable and Programmable Read Only Memory (EEPROM), an EPROM, a flash memory, a flexible disk, a Compact Disc Read Only Memory (CD-ROM), a Compact Disk Rewritable (CD-RW), a Digital Versatile Disk (DVD), a Secure Digital (SD) card, or a Magneto-Optical (MO) disc etc. The power supply control program is a computer-executable program written in legacy programming languages and object-oriented programming languages such as assembler, C, C++, C#, and Java etc., and the power supply control program can be distributed in the form of recording medium described above.

The driving power controller 22 is connected to the time management unit 23. For example, the time management unit 23 is implemented by a timer in the CPU. The time management unit 23 includes a clock (a time measurement unit) that keeps time and a timer. The driving power controller 22 controls supplying/cutting off driving power to each unit in the image forming apparatus 1, especially the plotter 21, and controls amount of supplied power based on time managed by the time management unit 23 and various thresholds stored in the internal memory described above. That is, the driving power controller 22 performs a mode switching process that controls amount of driving power supplied to each unit in the image forming apparatus 1 by switching from the normal mode (normal status) that supplies normal driving power that the plotter 21 etc. can work normally to the energy saving mode with less power consumption. In addition, if the current time falls in the time zone of shifting peak of power, the driving power controller 22 outputs a power switching signal to the switching/charging unit 33 and instructs the switching/charging unit 33 to supply driving power using the charged driving power supply.

Furthermore, the driving power controller 22 performs a status determination process that determines whether the image forming apparatus 1 is in the working status or the image forming apparatus 1 is in the standby status etc.

If the image forming apparatus 1 finishes the working status during the time zone of shifting peak of power, the driving power controller 22 performs a control process that switches from the normal mode to the energy saving mode immediately.

The external power supply (an external power supply unit) 31 includes a rectification circuit and a voltage adjustment circuit etc., and an AC commercial external power SP is supplied to the external power supply 31 via a power cable. The external power supply 31 generates external power used in the image forming apparatus 1 from the commercial external power SP supplied externally and outputs it to the switching/charging unit 33.

The storing power supply (a storing power supply unit) 32 includes a storage battery with a predetermined capacity and a voltage adjustment unit etc. A lithium-ion battery is used for the storage battery for example, and the storing power supply 32 is capable of supplying DC stored power. The storing power supply 32 generates stored driving power used in the image forming apparatus 1 from the power stored in the storage battery and outputs it to the switching/charging unit 33.

If the external power supply 31 supplies power and the power switching signal from the driving power controller 22 is not a stored power switching signal that uses the stored driving power as the driving power, the switching/charging unit (selection unit) 33 supplies the external power to the driving power controller 22 etc. as the driving power. In addition, if the external power supply 31 supplies power and the power switching signal from the driving power controller 22 is a stored power switching signal that uses the stored driving power as the driving power, the switching/charging unit 33 supplies the stored power to the driving power controller 22 etc. as the driving power. Furthermore, if the external power supply 31 does not supply power, the switching/charging unit 33 supplies the stored power to the driving power controller 22 etc. as the driving power. Lastly, if the external power supply 31 supplies power to the charging unit in the switching/charging unit 33, the switching/charging unit 33 charges the storage battery in the storing power supply 32.

It should be noted that the power supply unit 30 can include a stored amount detection unit that detects charge remaining of the storage battery in the storing power supply unit 32. For example, the stored amount detection unit (a charge remaining detection unit) detects charged amount by the switching/charging unit 33 and discharged amount discharged via the switching/charging unit 33, detects the charge remaining of the storage battery in the storing power supply unit 32 from the difference between the charged amount and the discharged amount, and outputs the detected charge remaining to the driving power controller 22.

Next, operation in this embodiment are described below. The image forming apparatus 1 in this embodiment reduces consumed amount of the stored driving power during the time zone of shifting peak of power effectively.

Figures 2A, 2B, 3:
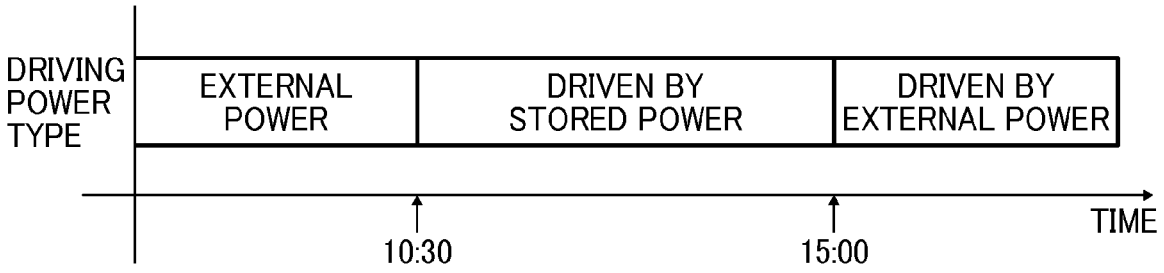
FIG. 2A is a table illustrating a time zone of shifting peak of power.
FIG. 2B is a table illustrating a time zone of prioritizing energy saving as an embodiment of the present invention.
FIG. 3 is a diagram illustrating shifting peak of electric power as an embodiment of the present invention.

That is, in the image forming apparatus 1, it is possible to configure the time zone of shifting peak of power in FIG. 2A by operating the configuration unit 15 or operating the host apparatus HS, and the CPU that implements the driving power controller 22 stores the configured time zone of shifting peak of power in the internal memory such as the NVRAM etc.

In addition, the image forming apparatus 1 includes the normal mode and the energy saving mode with less power consumption. In the image forming apparatus 1 is idling, if the time management unit 23 keeps waiting time preset and registered in the internal memory in the driving power controller 22 continuously, the driving power controller 22 switches from the normal mode to the energy saving mode.

If the external power supply 31 supplies power, the switching/charging unit 33 supplies the external power to the driving power controller 22 etc. as the driving power. If the external power is not supplied, the switching/charging unit 33 supplies the stored power generated by the storing power supply 32 to the driving power controller 22 etc. as the driving power.

If the current time that the time management unit 23 keeps is in the time zone of shifting peak of power, the driving power controller 22 outputs the power switching signal for selecting the stored power as the driving power to the switching/charging unit 33. If the power switching signal is input, the switching/charging unit 33 selects the stored power as the driving power and supplies it to the driving power controller 22 etc.

As shown in FIG. 3, if the external power is supplied, the switching/charging unit 33 selects the external power as the driving power, and while the power switching signal for selecting the stored power is input during the time zone of shifting peak of power, the switching/charging unit 33 selects the stored power as the driving power. If the power switching signal for selecting the stored power is not input and the external power is supplied, the switching/charging unit 33 selects the external power as the driving power. For example, as shown in FIG. 3, if the time zone of shifting peak of time is registered as time zone 10:30 to 15:00, the driving power controller 22 switches the driving power to the stored power at 10:30 and switches the driving power to the external power at 15:00. As a result, it is possible to reduce power consumption by the image forming apparatus 1 during daytime when the power consumption is in high demand. Consequently, by shifting peak of power, it is possible to improve merits on both sides of environment and electricity bill.

However, during the time zone of shifting peak of power, in case the stored power is supplied as the driving power, if the image forming apparatus 1 is switched from the normal mode to the energy saving mode after the waiting time elapses just like time zone other than the time zone of shifting peak of power, it is possible to consume more power during the waiting time, and that can be a problem.

Figure 4:
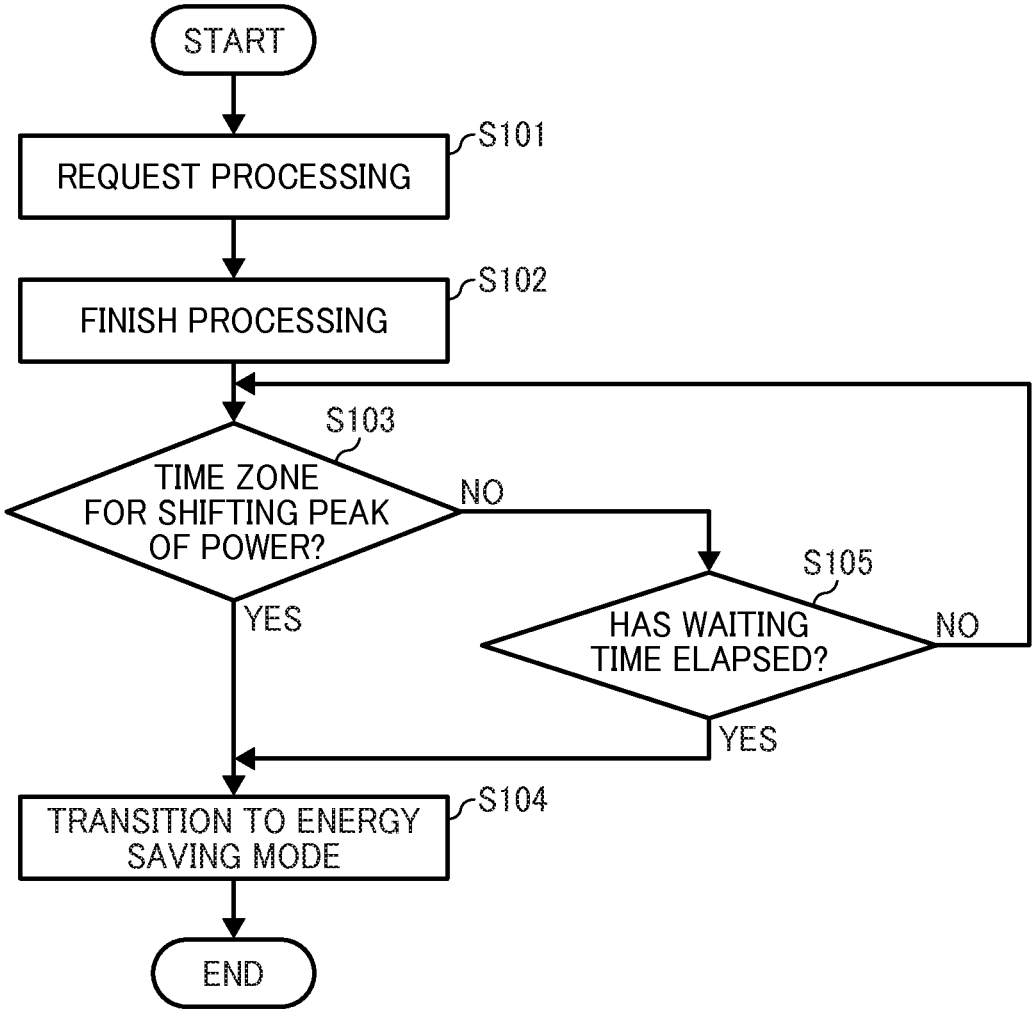
FIG. 4 is a flowchart illustrating a process for controlling energy saving as an embodiment of the present invention.

To cope with this issue, as shown in FIG. 4, the image forming apparatus 1 in this embodiment transitions to the energy saving mode immediately during the time zone of shifting peak of power. That is, as shown in FIG. 4, after receiving a request for operating the image forming apparatus 1, the image controller 10 processes the request for the operation in S101. For example, the request for printing may be received at the image forming apparatus 1. The driving power controller 22 manages the status of the image forming apparatus 1 and detects whether or not it is finished to perform the requested operation in S102.

After finishing the requested operation, the driving power controller 22 checks whether or not the current time that the time management unit 23 keeps is within the time zone of shifting peak of power stored in the internal memory in the driving power controller 22 in S103.

If the current time is within the time zone of shifting peak of power (YES in S103), the driving power controller 22 transitions power mode (driving power mode) to the energy saving mode immediately and finishes the energy saving control process in S104.

If the current time is not within the time zone of shifting peak of power (NO in S103), the driving power controller 22 checks whether or not idling time after finishing the requested operation that the timer in the time management unit 23 keeps reaches the waiting time stored in the internal memory in the driving power controller 22 in S105. In this example, the time management unit 23 starts counting a time period when the requested operation is completed at S102.

If the idling time does not reach the waiting time (NO in S105), the driving power controller 22 repeats the steps described above from checking whether or not it is within the time zone of shifting peak of power (S103 to S105).

If the idling time reaches the waiting time in S105, the driving power controller 22 transitions the image forming apparatus 1 from the idling status of the normal mode to the energy saving mode and finishes the energy saving control process in S104.

As described above, after finishing the operation during the time zone of shifting peak of power, it is possible to transition to the energy saving mode immediately without waiting until the waiting time elapses. As a result, it is possible to reduce the consumption of the stored power during the time zone of shifting peak of power. Consequently, it is possible to utilize the image forming apparatus 1 for a longer period of time even in a time of emergency such as outage etc.

Figure 5:
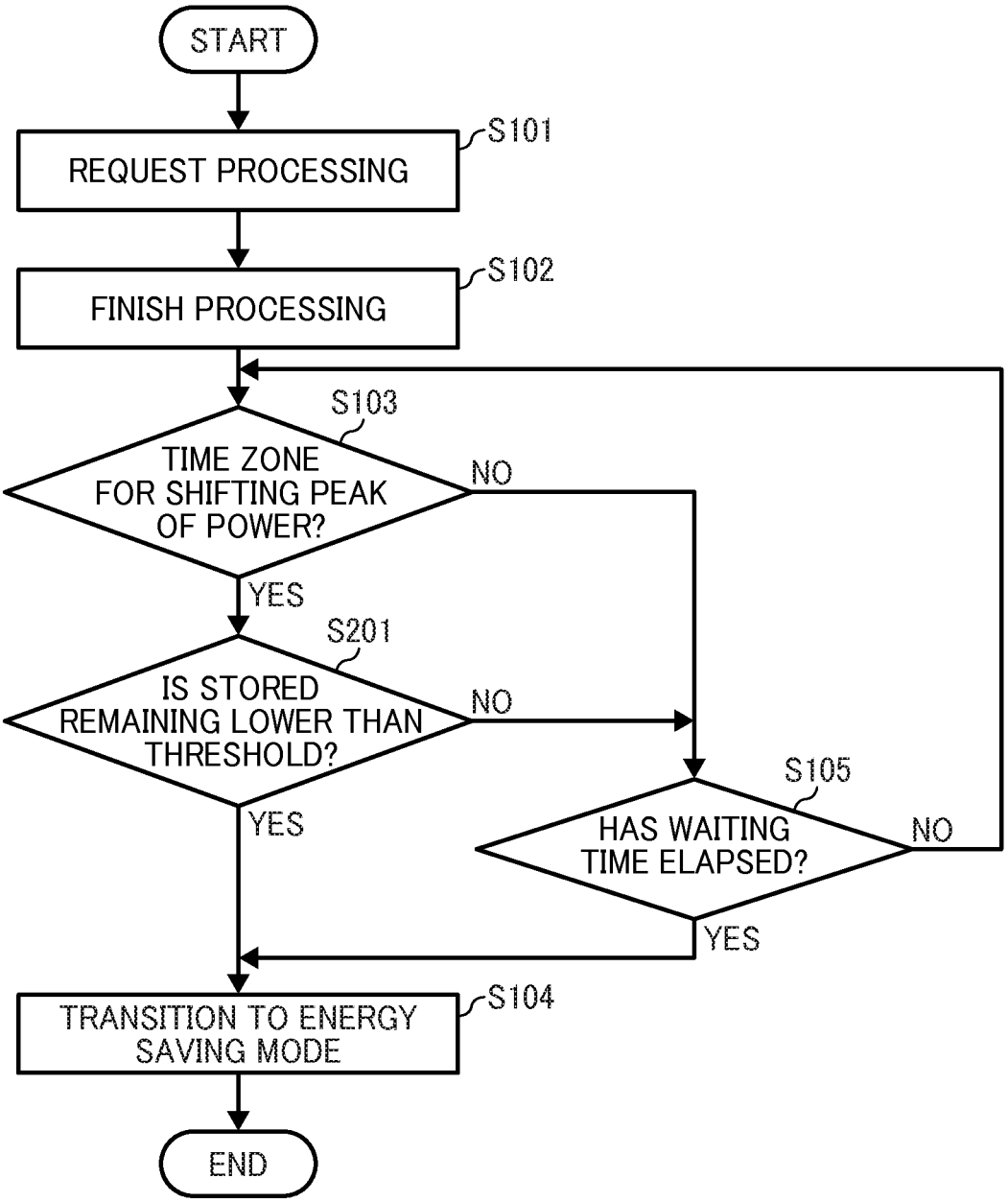
FIG. 5 is a flowchart illustrating a process for controlling energy saving based on charge remaining as an embodiment of the present invention.

In the above description, after finishing the operation, it is transitioned to the energy saving mode immediately during the time zone of shifting peak of power. However, as shown in FIG. 5 for example, it is possible to perform the energy saving control based on the charge remaining of the storage battery in the storing power supply 32 (shown in FIG. 2B). In FIG. 5, same symbols are assigned to steps similar to steps in FIG. 4, and those descriptions are simplified.

In this case, the power supply unit 30 includes the stored amount detection unit as described above, and the stored amount detection unit (a charge remaining detection unit) detects the charge remaining of the storage battery in the storing power supply unit 32.

As shown in FIG. 5, after receiving a request for operating the image forming apparatus 1, the image controller 10 processes the request for the operation in S101. The driving power controller 22 manages the status of the image forming apparatus 1 and detects whether or not it is finished to perform the requested operation in S102.

After finishing the requested operation, the driving power controller 22 checks whether or not the current time that the time management unit 23 keeps is within the time zone of shifting peak of power in S103.

If the current time is within the time zone of shifting peak of power (YES in S103), the driving power controller 22 checks whether or not the charge remaining of the storing power supply unit 32 that the stored amount detection unit detects is equal to or less than the threshold of charge remaining described above in S201.

If the charge remaining is more than the threshold of charge remaining (NO in S201), the driving power controller 22 transitions to the idling status in the normal mode and checks whether or not the waiting time elapses in S105.

If the idling time does not reach the waiting time (NO in S105), the driving power controller 22 repeats the steps described above from checking whether or not it is within the time zone of shifting peak of power (S103, 5201, and S105).

If the charge remaining is equal to or less than the threshold of charge remaining (YES in S201), the driving power controller 22 transitions the image forming apparatus 1 to the energy saving mode immediately and finishes the energy saving control process in S104.

If the current time is not within the time zone of shifting peak of power (NO in S103), the driving power controller 22 checks whether or not the idling time reaches the waiting time in S105.

If the idling time does not reach the waiting time (NO in S105), the driving power controller 22 repeats the steps described above from checking whether or not it is within the time zone of shifting peak of power (S103, 5201, and S105).

If the idling time reaches the waiting time in S105, the driving power controller 22 transitions the image forming apparatus 1 from the idling status of the normal mode to the energy saving mode and finishes the energy saving control process in S104.

As described above, after finishing the operation during the time zone of shifting peak of power, if the charge remaining of the storage battery in the storing power supply unit 32 becomes equal to or less than the threshold of charge remaining, it is possible to transition to the energy saving mode immediately. As a result, it is possible to reduce the consumption of the stored power during the time zone of shifting peak of power. Consequently, it is possible to utilize the image forming apparatus 1 for a longer period of time even in a time of emergency such as outage etc.

Figure 6:
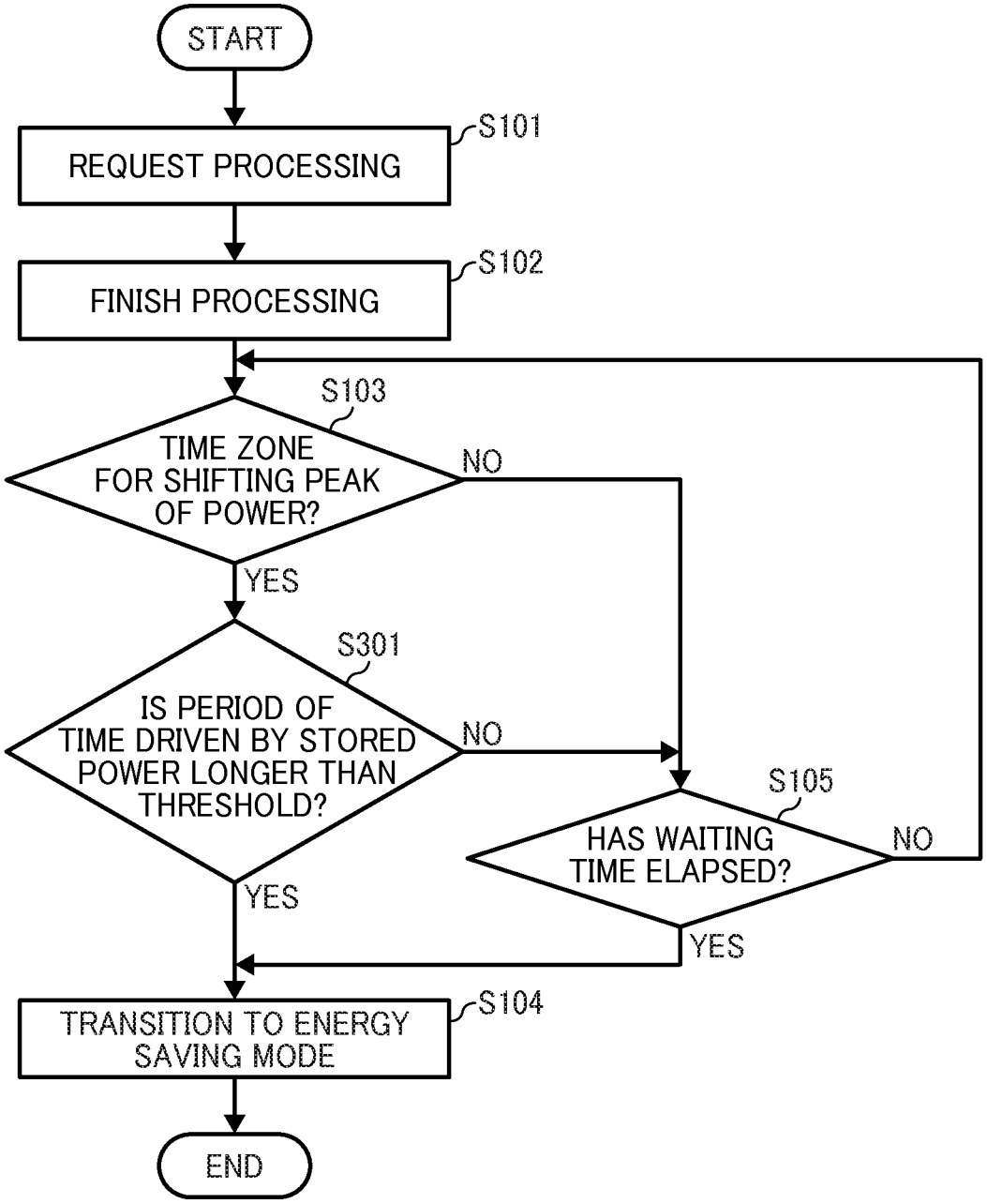
FIG. 6 is a flowchart illustrating a process for controlling energy saving based driving time using the charged power supply as an embodiment of the present invention.

Furthermore, the image forming apparatus 1 in this embodiment can perform the energy saving control based on the driving time using the stored power described above as shown in FIG. 6. In FIG. 6, same symbols are assigned to steps similar to steps in FIG. 4, and those descriptions are simplified.

That is, as described above, the threshold of driving time using the storage battery is stored in the internal memory of the driving power controller 22. In addition, as described above, the threshold of driving time using the storage battery indicates threshold time that the normal mode is switched to the energy saving mode immediately in the time zone of shifting peak of power, and the threshold of driving time using the storage battery indicates threshold time in accumulating predicted working time using the storage battery in the time zone of shifting peak of power when the charged storage battery supplies driving power. More specifically, the driving power controller 22 predicts the accumulated working time using the storage battery from the accumulated working time using the storage battery since the time zone of shifting peak of power starts up to now and remaining time in the time zone of shifting peak of power, and the driving power controller 22 predicts the accumulated predicted working time using the storage battery by accumulating all the working time using the storage battery during the time zone of shifting peak of power. The threshold of driving time using the storage battery is time for allowing having the waiting time for switching from the normal mode to the energy saving mode against the accumulated predicted working time using the storage battery.

When the current time that the time management unit 23 keeps gets in the time zone of shifting peak of power, the driving power controller 22 calculates the accumulated predicted working time using the storage battery at a predetermined timing, compares the accumulated predicted working time using the storage battery with the threshold of working time using the storage battery, and determines whether or not the image forming apparatus 1 transitions from the normal mode to the energy saving mode.

That is, as shown in FIG. 6, after receiving a request for operating the image forming apparatus 1, the image controller 10 processes the request for the operation in S101. The driving power controller 22 manages the status of the image forming apparatus 1 and detects whether or not it is finished to perform the requested operation in S102.

After finishing the requested operation, the driving power controller 22 checks whether or not the current time that the time management unit 23 keeps is within the time zone of shifting peak of power in S103.

If the current time is within the time zone of shifting peak of power (YES in S103), the driving power controller 22 calculates the accumulated predicted working time using the storage battery during the time zone of shifting peak of power, and the driving power controller 22 checks whether or not the accumulated predicted working time using the storage battery is more than the threshold of working time using the stored power in S301.

If the accumulated predicted working time using the storage battery is equal to or less than the threshold of working time using the stored power (NO in S301), the driving power controller 22 transitions to the idling status in the normal mode and checks whether or not the waiting time elapses in S105.

If the idling time does not reach the waiting time (NO in S105), the driving power controller 22 repeats the steps described above from checking whether or not it is within the time zone of shifting peak of power (S103, 5301, and S105).

If the accumulated predicted working time using the storage battery is more than the threshold of working time using the stored power (YES in S301), the driving power controller 22 transitions to the energy saving mode immediately and finishes the energy saving control process in S104.

If the current time is not within the time zone of shifting peak of power (NO in S103), the driving power controller 22 checks whether or not the idling time reaches the waiting time in S105.

If the idling time does not reach the waiting time (NO in S105), the driving power controller 22 repeats the steps described above from checking whether or not it is within the time zone of shifting peak of power (S103, S301, and S105).

If the idling time reaches the waiting time in S105, the driving power controller 22 transitions the image forming apparatus 1 from the idling status of the normal mode to the energy saving mode and finishes the energy saving control process in S104.

As described above, during the time zone of shifting peak of power, if the accumulated predicted working time using the storage battery becomes more than the threshold of working time using the stored power and it is possible that the charge remaining of the storage battery in the storing power supply 32 goes down, it is possible to transition to the energy saving mode immediately. As a result, it is possible to reduce the consumption of the stored power supply during the time zone of shifting peak of power. Consequently, it is possible to utilize the image forming apparatus 1 for a longer period of time even in a time of emergency such as outage etc.

Figure 7:
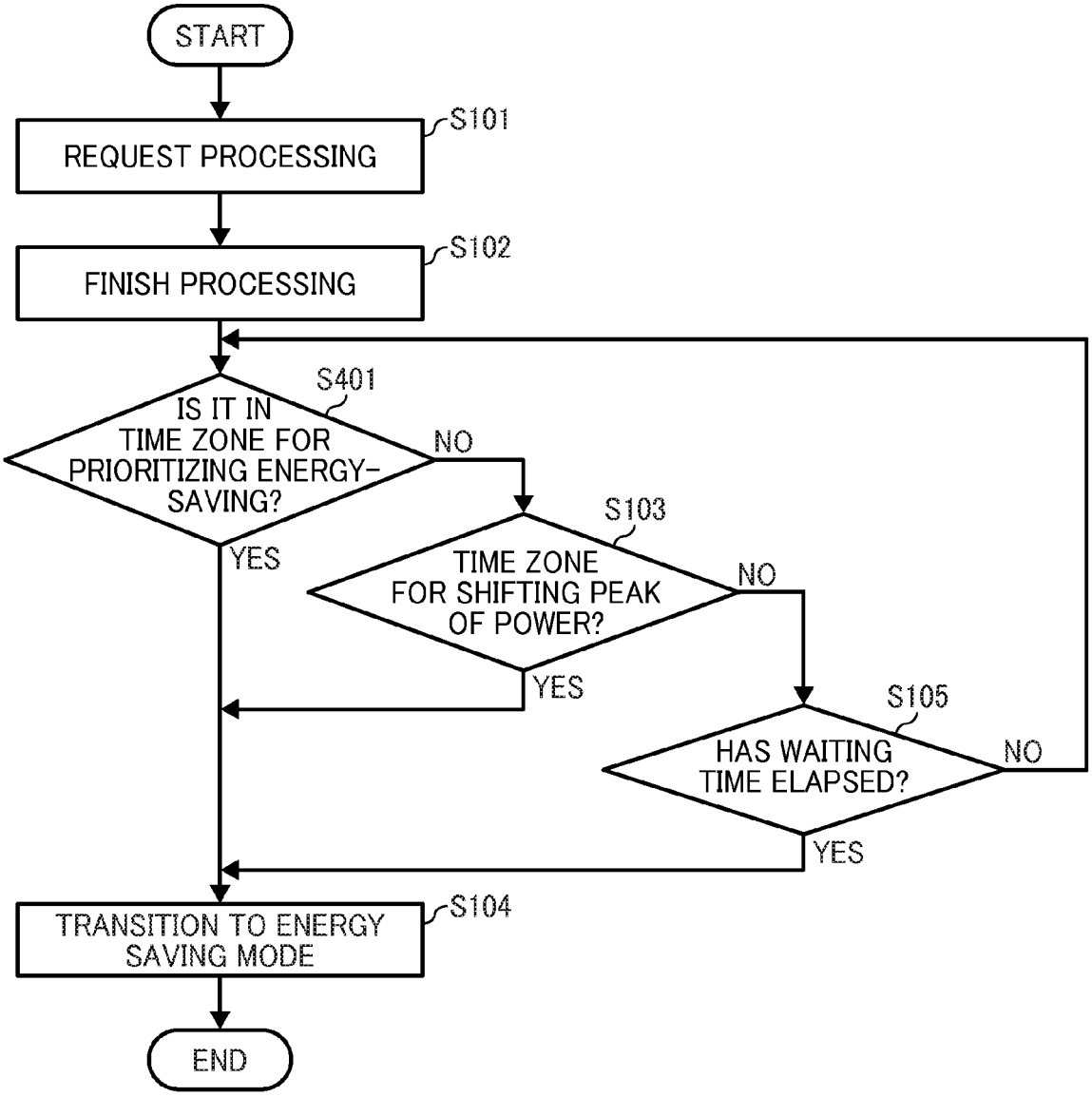
FIG. 7 is a flowchart illustrating a process for controlling energy saving based time zone of prioritizing energy saving as an embodiment of the present invention.

Furthermore, the image forming apparatus 1 in this embodiment can perform the energy saving control based on whether or not the current time falls in the time zone of prioritizing energy saving (shown in FIG. 2A) even if the current time falls in the time zone of shifting peak of power. In FIG. 7, same symbols are assigned to steps similar to steps in FIG. 4, and those descriptions are simplified.

In the time zone of prioritizing energy saving, as described above, the normal mode is switched to the energy saving mode immediately and preferentially during the time zone of shifting peak of power. The time zone of prioritizing energy saving is stored in the internal memory of the driving power controller 22, and the time zone of prioritizing energy saving can be configured and registered appropriately by operating the configuration unit 15.

That is, as shown in FIG. 7, after receiving a request for operating the image forming apparatus 1, the image controller 10 processes the request for the operation in S101. The driving power controller 22 manages the status of the image forming apparatus 1 and detects whether or not it is finished to perform the requested operation in S102.

After finishing the requested operation, the driving power controller 22 checks whether or not the current time falls in the time zone of prioritizing energy saving in S401.

If the current time is within the time zone of prioritizing energy saving (YES in S401), the driving power controller 22 transitions to the energy saving mode immediately and finishes the energy saving control process in S104.

If the current time does not fall in the time zone of prioritizing energy saving (NO in S401), the driving power controller 22 checks whether or not the current time that the time management unit 23 keeps is within the time zone of shifting peak of power in S103.

If the current time is within the time zone of shifting peak of power (YES in S103), the operation proceeds to S104.

If the current time is not within the time zone of shifting peak of power (NO in S103), the driving power controller 22 transitions to the idling status in the normal mode and checks whether or not the waiting time elapses in S105.

If the idling time does not reach the waiting time (NO in S105), the driving power controller 22 repeats the steps described above from checking whether or not it is within the time zones of prioritizing energy saving and shifting peak of power (S401, S103, and S105).

If the idling time reaches the waiting time in S105, the driving power controller 22 transitions the image foil ling apparatus 1 from the idling status of the normal mode to the energy saving mode and finishes the energy saving control process in S104.

As described above, if the current time is within the time zone of prioritizing energy saving, it is possible to transition to the energy saving mode immediately. As a result, it is possible to reduce the consumption of the stored power supply during the time zone of shifting peak of power. Consequently, it is possible to utilize the image forming apparatus 1 for a longer period of time even in a time of emergency such as outage etc.

As described above, in the image forming apparatus 1 in this embodiment, the power supply controlling unit 40 includes the external power supply (the external power supply unit) 31 that generates the external driving power used in the image forming apparatus 1 from the commercial external power SP supplied externally, the storing power supply (the storing power supplying unit) 32 that generates the stored driving power used in the image forming apparatus 1 from the stored power, the switching/charging unit (the selection unit) 33 that selects either the external driving power or the stored driving power as the driving power supplied to the image forming apparatus 1, the driving power controller (the power mode switching unit) 22 that switches from the normal mode that supplies normal driving power that can work normally to the energy saving mode with less power consumption and vice versa, the clock unit in the time management unit (the time keeping unit) 23 that keeps time, the driving power controller (the determination unit) 22 that determines whether or not the current time is within the time zone of shifting peak of power when the usage of the external power is held down, the driving power controller (the status determination unit) 22 that determines the status of the image forming apparatus 1, the driving power controller (controlling unit) 22 that instructs the driving power controller 22 as the selection unit to select the stored power as the driving power and instructs the driving power controller 22 as the power mode switching unit to switch the power mode to the energy saving mode immediately after the driving power controller 22 as the status determination unit determines that the operational status has ended during the time zone of shifting peak of power.

Therefore, during the time zone of shifting peak of power, it is possible to select the stored power as the driving power and performs the operation, and it is possible to transition to the energy saving mode immediately after finishing the operation. As a result, it is possible to reduce the consumption of the stored power during the time zone of shifting peak of power effectively, and it is possible to extend the working time using the stored power as the driving power.

In the image forming apparatus 1 in this embodiment, the power supply controlling unit 40 further includes the stored amount detection unit (the charge remaining detection unit) that detects the charge remaining stored in the storing power supply 32, and the driving power controller 22 as the controlling unit instructs the driving power controller 22 as the power mode switching unit to switch the power mode to the energy saving mode if the charge remaining is equal to or less than the predetermined threshold of charge remaining.

As a result, it is possible to transition to the energy saving mode immediately after finishing the operation if the charge remaining of the storage battery in the storing power supply 32 becomes lower than the threshold of the charge remaining during the time zone of shifting peak of power. As a result, it is possible to reduce the consumption of the stored power supply during the time zone of shifting peak of power. Consequently, it is possible to utilize the image forming apparatus 1 for a longer period of time even in a time of emergency such as outage etc.

In the image forming apparatus 1 in this embodiment, the power supply controlling unit 40 further includes the driving power controller (the working time using stored power calculation unit) 22 that calculates the accumulated predicted working time using the storage battery by accumulating the predicted working time using the storage battery as the driving power during the time zone of shifting peak of power, and the driving power controller 22 as the controlling unit instructs the driving power controller 22 as the power mode switching unit to switch the power mode to the energy saving mode if accumulated predicted working time using the storage battery is more than the predetermined threshold of working time using the stored power.

Consequently, during the time zone of shifting peak of power, if the accumulated predicted working time using the storage battery becomes more than the threshold of working time using the stored power and it is possible that the charge remaining of the storage battery in the storing power supply 32 goes down, it is possible to transition to the energy saving mode immediately. As a result, it is possible to reduce the consumption of the stored power supply during the time zone of shifting peak of power. Consequently, it is possible to utilize the image forming apparatus 1 for a longer period of time even in a time of emergency such as outage etc.

In the image forming apparatus 1 in this embodiment, the power supply controlling unit 40 further includes the memory (the time memory unit) in the time management unit 23 that stores the time zone of prioritizing energy saving when the power mode is switched to the energy saving mode preferentially, and the driving power controller 22 as the controlling unit instructs the driving power controller 22 as the power mode switching unit to switch the power mode to the energy saving mode if the current time is within the time zone of prioritizing energy saving.

Consequently, if the current time is within the time zone of shifting peak of power and the time zone of prioritizing energy saving, it is possible to transition to the energy saving mode immediately, and it is possible to transition to the energy saving mode at a necessary timing much more. As a result, it is possible to reduce the consumption of the stored power supply during the time zone of shifting peak of power. Consequently, it is possible to utilize the image forming apparatus 1 for a longer period of time even in a time of emergency such as outage etc.

The image forming apparatus 1 in this embodiment further includes the operation display unit (the configuration unit) that configures at least any one of the threshold of charge remaining, the threshold of working time using stored power, and the time zone of prioritizing energy saving.

Consequently, it is possible to configure the threshold of charge remaining, the threshold of working time using stored power, and the time zone of prioritizing energy saving appropriately in accordance with availability of the image forming apparatus 1 etc., and it is possible to reduce the consumption of the stored power during the time zone of shifting peak of power with enhancing usability.

Numerous additional modifications and variations are possible in light of the above teachings. It is therefore to be understood that, within the scope of the appended claims, the disclosure of this patent specification may be practiced otherwise than as specifically described herein. As can be appreciated by those skilled in the computer arts, this invention may be implemented as convenient using a conventional general-purpose digital computer programmed according to the teachings of the present specification. Appropriate software coding can readily be prepared by skilled programmers based on the teachings of the present disclosure, as will be apparent to those skilled in the software arts. The present invention may also be implemented by the preparation of application-specific integrated circuits or by interconnecting an appropriate network of conventional component circuits, as will be readily apparent to those skilled in the relevant art. Each of the functions of the described embodiments may be implemented by one or more processing circuits. A processing circuit includes a programmed processor, as a processor includes circuitry. A processing circuit also includes devices such as an application specific integrated circuit (ASIC) and conventional circuit components arranged to perform the recited functions.

What is claimed is:

1. A power supply control device, comprising:

an external power supply unit to generate external driving power to be supplied to an image processing apparatus from an external power source;

a storing power supplying unit to generate stored driving power to be supplied to the image processing apparatus from a stored power source;

a selection unit to select either the external driving power or the stored driving power as driving power supplied to the image processing apparatus;

a power mode switching unit to switch a power mode of the image processing apparatus between a normal mode and an energy saving mode, the energy saving mode consuming less power consumption than power consumption for the normal mode;

a determination unit to determine whether or not a current time is within a peak power shift time zone in which usage of the external power is suppressed, and further determine whether the image processing apparatus is performing an operation;

a charge remaining detection unit to detect charge remaining stored in the storing power supplying unit; and a controlling unit to instruct the selection unit to select the stored power as the driving power when the determination unit determines that the current time is within the peak power shift time zone, and further instruct the power mode switching unit to switch the power mode of the image processing apparatus to the energy saving mode immediately after the image processing apparatus ends the operation being performed during the power peak shift time zone, or upon the detected charge remaining being equal to or less than a threshold of charge remaining.

2. The power supply controlling device of claim 1, further comprising a stored power calculation unit to calculate accumulated predicted working time using the stored power by accumulating predicted working time using the stored power as the driving power during the power peak shift time zone, wherein the controlling unit instructs the power mode switching unit to switch power mode to the energy saving mode upon accumulated predicted working time using the stored power being greater than a threshold of working time using the stored power.

3. The power supply controlling device of claim 1, further comprising a memory to store a value indicating a time zone for prioritizing energy saving, wherein the controlling unit instructs the power mode switching unit to switch the power mode to the energy saving mode immediately if the current time is within the time zone for prioritizing energy saving without determining whether the image processing apparatus ends the operation.

4. The power supply controlling device of claim 1, further comprising a configuration unit to configure at least one of a threshold of charge remaining, a threshold of working time using the stored power, and a time zone for prioritizing energy saving.

5. An image processing apparatus, comprising the power supply controlling device of claim 1.

6. A method of controlling a power supply, the method comprising:

generating external driving power to be supplied to an image processing apparatus from an external power source;

generating stored driving power to be supplied to the image processing apparatus from a stored power source;

selecting either the external driving power or the stored driving power as driving power supplied to the image processing apparatus;

switching a power mode of the image processing apparatus between a normal mode and an energy saving mode, the energy saving mode consuming less power consumption than power consumption for the normal mode;

determining whether or not a current time is within a peak power shift time zone in which usage of the external power is suppressed;

instructing to select the stored power as the driving power when the determining determines that the current time is within the peak power shift time zone;

determining whether the image processing apparatus is performing an operation when the determining determines that the current time is within the peak power shift time zone;

detecting a charge remaining stored in the storing power supplying unit: and instructing to switch the power mode of the image processing apparatus to the energy saving mode immediately after the image processing apparatus ends the operation being performed during the power peak shift time zone and upon the detected charge remaining being equal to or less than a threshold of charge remaining.

7. A non-transitory, computer-readable recording medium storing a program that, when executed by a processor, causes the processor to implement the method of claim 6.

8. The method of claim 6, further comprising:

configuring at least one of a threshold of charge remaining, a threshold of working time using the stored power, and a time zone for prioritizing energy saving.

9. A power supply control device, comprising:

an external power supply unit to generate external driving power to be supplied to an image processing apparatus from an external power source;

a storing power supplying unit to generate stored driving power to be supplied to the image processing apparatus from a stored power source;

a selection unit to select either the external driving power or the stored driving power as driving power supplied to the image processing apparatus;

a power mode switching unit to switch a power mode of the image processing apparatus between a normal mode and an energy saving mode, the energy saving mode consuming less power consumption than power consumption for the normal mode;

a determination unit to determine whether or not a current time is within a peak power shift time zone in which usage of the external power is suppressed, and further determine whether the image processing apparatus is performing an operation;

a stored power calculation unit to calculate accumulated predicted working time using the stored power by accumulating predicted working time using the stored power as the driving power during the power peak shift time zone; and a controlling unit to instruct the selection unit to select the stored power as the driving power when the determination unit determines that the current time is the peak power shift time zone, and further instruct the power mode switching unit to switch the power mode of the image processing apparatus to the energy saving mode immediately after the image processing apparatus ends the operation being performed during the power peak shift time zone and upon the calculated accumulated predicted working time using the stored power being greater than a threshold of working time using the stored power.

10. An image processing apparatus, comprising the power supply controlling device of claim 9.

11. The power supply controlling device of claim 9, further comprising:

a configuration unit to configure at least one of a threshold of charge remaining, a threshold of working time using the stored power, and a time zone for prioritizing energy saving.

* * * * *